US006425790B2

(12) United States Patent
Nakata et al.

(10) Patent No.: US 6,425,790 B2
(45) Date of Patent: Jul. 30, 2002

(54) EXHAUST ARRANGEMENT FOR OUTBOARD MOTOR

(75) Inventors: Jun Nakata; Yasuhiko Shibata, both of Shizuoka (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/732,623

(22) Filed: Dec. 8, 2000

(30) Foreign Application Priority Data

Dec. 8, 1999 (JP) ..... 11-348650

(51) Int. Cl.[7] ..... B63H 21/32
(52) U.S. Cl. ..... 440/89; 60/323
(58) Field of Search ..... 440/88, 89; 60/323

(56) References Cited

U.S. PATENT DOCUMENTS

| | | | |
|---|---|---|---|
| 3,493,081 | A | 2/1970 | Tado |
| 4,452,194 | A | 6/1984 | Watanabe |
| 4,498,875 | A | 2/1985 | Watanabe |
| 4,523,556 | A | 6/1985 | Suzuki |
| 4,562,797 | A | 1/1986 | Suzuki |
| 4,611,559 | A | 9/1986 | Sumigawa |
| 4,709,671 | A | 12/1987 | Sumigawa |
| 4,828,519 | A | 5/1989 | Watanabe |
| 5,072,809 | A | 12/1991 | Shibata |
| 5,118,316 | A | 6/1992 | Kakizaki et al. |
| 5,215,164 | A | 6/1993 | Shibata |
| 5,232,387 | A | 8/1993 | Sumigawa |
| 5,439,404 | A | 8/1995 | Sumigawa |
| 5,462,464 | A | 10/1995 | Ming |
| 5,487,687 | A | 1/1996 | Idzikowski et al. |
| 5,487,688 | A | 1/1996 | Sumigawa |
| 5,501,624 | A | 3/1996 | Matsumoto et al. |
| 5,704,819 | A | 1/1998 | Isogawa |
| 5,733,157 | A | 3/1998 | Okuzawa et al. |
| 5,752,866 | A | 5/1998 | Takahashi et al. |
| 5,769,038 | A | 6/1998 | Takahashi et al. |
| 5,778,848 | A | 7/1998 | Takahashi et al. |
| 5,876,188 | A | 3/1999 | Okamoto |
| 5,876,256 | A | 3/1999 | Takahashi et al. |
| 5,893,783 | A | 4/1999 | Hiraoka et al. |
| 5,921,829 | A | 7/1999 | Iwata |
| 5,934,957 | A | 8/1999 | Sato et al. |
| 5,934,960 | A | 8/1999 | Katayama et al. |
| 5,937,801 | A | 8/1999 | Davis |
| 6,012,956 | A | 1/2000 | Mishima et al. |
| 6,027,385 | A | 2/2000 | Katayama et al. |
| 6,039,618 | A | 3/2000 | Hiraoka et al. |
| 6,082,343 | A | 7/2000 | Oishi et al. |
| 6,126,499 | A | 10/2000 | Katayama et al. |

*Primary Examiner*—Jesus D. Sotelo
(74) *Attorney, Agent, or Firm*—Knobbe, Martens, Olson & Bear, LLP.

(57) ABSTRACT

An outboard motor has an exhaust pipe assembly extending through a driveshaft housing. The exhaust pipe is separated into an upstream exhaust pipe and a downstream exhaust pipe which are formed separately from each other. The upstream exhaust pipe depends into the driveshaft housing and has a lower end connected to a pipe support member. An upper end of the downstream exhaust pipe connects to the pipe support member in a manner to communicate with the upstream exhaust pipe. The downstream pipe depends through an opening in a bottom wall of the driveshaft housing, and a mount at the lower end of the pipe is connected to the driveshaft housing in order to secure the pipe in place. The upper end of the downstream exhaust pipe is fit into the pipe support member without the use of fasteners. In this configuration, the downstream exhaust pipe can be removed independently of the upstream exhaust pipe, and can be drawn downwardly through the opening during removal. This enables the downstream exhaust pipe to be easily and quickly replaced.

24 Claims, 7 Drawing Sheets

EXHAUST ARRANGEMENT FOR OUTBOARD MOTOR

PRIORITY INFORMATION

This application claims priority to Japanese Application No. Hei 11-348650, which was filed on Dec. 8, 1999, the entirety of which is hereby incorporated by reference.

BACKGROUND OF THE INVENTION

1. Field of the Invention

This invention relates to an outboard motor, and more particularly to an improved exhaust arrangement for outboard motors having four-cycle internal combustion engines.

2. Description of the Related Art

Outboard motors are generally attached to a transom of a watercraft and are used to propel the watercraft. These motors comprise an internal combustion engine arranged to drive a water propulsion device, such as a propeller.

The outboard motor is connected to the watercraft in a manner that permits the motor to turn from side-to-side about a vertically extending axis in order to steer the watercraft. In addition, the motor is tiltable about a generally horizontal axis in order to trim the motor.

For a variety of reasons, outboard motors are constructed to be very compact. Such motors also must to be substantially self-contained. Thus, the cooling, exhaust and silencing systems are substantially contained within the motor.

In an outboard motor employing a four-cycle engine, a source of lubricant is required to hold lubricant that is circulated through the engine. In order to provide adequate storage capacity within the compact arrangement of the outboard motor, the lubricant tank is generally positioned in the driveshaft housing below the engine. An exhaust pipe depends from the engine into the driveshaft housing and is positioned adjacent to or through the lubricant tank. Thus, in some outboard motors, the lubricant tank generally encircles the exhaust pipe. Such positioning of the lubricant tank exposes the tank to hot exhaust gases which can heat the lubricant in the lubricant tank. Excessive heat degrades the lubricant, possibly leading to engine damage.

Outboard motors also conventionally employ an open-loop cooling system that draws cooling water from the body of water in which the outboard motor is operated (e.g., a lake or an ocean). The cooling water is directed through cooling passages in the engine in order to cool the engine, and is also directed onto the outer walls of the lubricant tank and around the exhaust pipe in order to cool the lubricant and exhaust.

A lower portion of the exhaust pipe is often connected to a coolant outlet, which directs coolant into the pipe. Injecting coolant into the exhaust system both cools the exhaust and enhances engine silencing. The mixed coolant and exhaust gas are discharged into the body of water through an exhaust system discharge.

It has been found that when coolant such as saltwater is vigorously mixed with exhaust gases, certain corrosive gases can be generated. Because the coolant and exhaust gases are usually mixed in the lower portion of the exhaust pipe, the corrosive gases tend to concentrate their effect on the lower portion of the exhaust pipe, and thus the lower end or lower opening of the exhaust pipe may be corroded even when the rest of the exhaust pipe remains relatively unaffected by corrosion.

In a conventional outboard motor, an upper end of the exhaust pipe is typically fitted and secured to an exhaust guide portion of the motor. Additionally, caulking and/or gaskets may be used to create a sealing fit of the upper end of the exhaust pipe and the exhaust guide. Since the lubricant tank often surrounds the upper end of the exhaust pipe, it can be very difficult to disassemble or remove the exhaust pipe when service is required, such as when corrosion is noted on the lower end of the exhaust pipe. This arrangement leads to waste of time and materials because not only is it difficult and time-consuming to replace the entire exhaust pipe, but it is also wasteful to replace the entire exhaust pipe when only the lower portion of the pipe is corroded.

SUMMARY OF THE INVENTION

Accordingly, there is a need in the art for an outboard motor having an exhaust system allowing for relatively easy and inexpensive change-out of portions of the exhaust system that are most likely to become corroded and require replacement. Such an exhaust system would save effort by making it easier to replace corroded parts; it would also save in materials costs by requiring replacement of only a relatively small portion of the exhaust system rather than the entire exhaust pipe when only a portion of the exhaust pipe exhibits corrosion.

In accordance with an aspect of the present invention, an outboard motor is provided having a power head including an internal combustion engine, a driveshaft housing depending from the power head, and a lower unit depending from the driveshaft housing. An upstream exhaust pipe receives exhaust gases from the engine and depends into the driveshaft housing. A downstream exhaust pipe is formed separately from the upstream exhaust pipe and communicates therewith. The downstream exhaust pipe opens into an exhaust chamber formed in the lower unit and is removable from the driveshaft housing independently from the upstream exhaust pipe.

In accordance with another aspect, the invention provides an outboard motor comprising a power head, a driveshaft housing depending from the power head, a lower unit depending from the driveshaft housing, an internal combustion engine enclosed within the power head and adapted to drive a crankshaft, and an exhaust system adapted to communicate exhaust products from the engine to an exhaust discharge located on the lower unit. The exhaust system has an upstream exhaust pipe, a downstream exhaust pipe, and an exhaust ipie support member. The upstream exhaust pipe depends into the driveshaft housing and is supported by the exhaust pipe support member. The downstream exhaust pipe depends from the exhaust pipe support member and through an opening formed through a bottom wall of the driveshaft housing. Also, the downstream exhaust pipe has a mount portion adapted to releasably engage the driveshaft housing. The downstream pipe and the opening are configured so that the downstream exhaust pipe can be drawn downwardly through the opening to remove the downstream pipe from the driveshaft housing.

In accordance with yet another aspect of the invention, an outboard motor has a power head including an internal combustion engine, a driveshaft housing depending from the power head, and a lower unit depending from the driveshaft housing. An exhaust pipe assembly guides exhaust products through at least a portion of the driveshaft housing, and includes an upstream exhaust pipe section and a downstream exhaust pipe section. The downstream exhaust pipe section extends through an opening in a bottom wall of the driveshaft housing. The exhaust system further includes means for removably securing the downstream pipe section to the driveshaft housing in a manner so that an upper end of the downstream pipe section communicates with a lower end of the upstream pipe section and the downstream pipe section is removable by drawing the downstream pipe section downwardly through the opening.

In accordance with a still further aspect, the present invention provides an outboard motor comprising a power head, a driveshaft housing depending from the power head, a lower unit depending from the driveshaft housing, and an internal combustion engine enclosed within the power head and adapted to drive a crankshaft. The crankshaft rotatably communicates with a propulsion device provided on the lower unit. A coolant chamber is defined within the driveshaft housing. An exhaust system is provided and is adapted to communicate exhaust products from the engine to an exhaust discharge disposed at the lower unit. The exhaust system has an upstream exhaust pipe, a downstream exhaust pipe, and an exhaust pipe support member. The upstream exhaust pipe depends into the driveshaft housing and is supported by the exhaust pipe support member. The downstream exhaust pipe depends from the exhaust pipe support member and is configured to be removable from the driveshaft housing independent of the upstream exhaust pipe. A drain passage is formed through a wall of the downstream pipe and communicates with the coolant chamber.

Further aspects, features and advantages of the present invention will become apparent from the Detailed Description of Preferred Embodiments which follows.

BRIEF DESCRIPTION OF THE DRAWINGS

The above-mentioned and other features of the invention will now be described with reference to the drawings of preferred embodiments of the present outboard motor. The illustrated embodiments are intended to illustrate, but not to limit, the invention. The drawings contain the following figures.

DETAILED DESCRIPTION OF PREFERRED EMBODIMENTS

Figure 1:
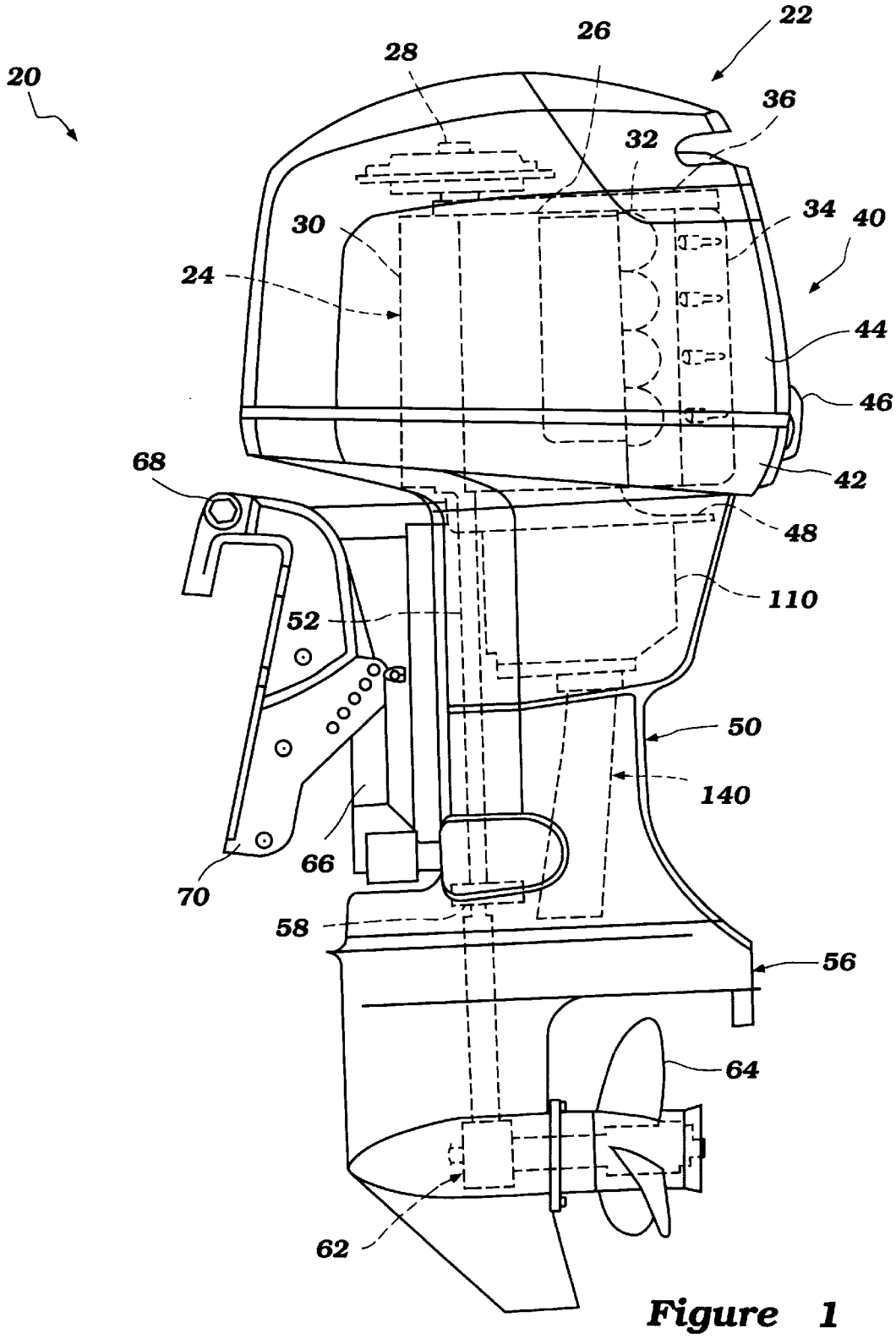
FIG. 1 is a side elevational view of an outboard motor constructed in accordance with an embodiment of the invention.

With reference initially to FIG. 1, an outboard motor constructed in accordance with a first embodiment of the invention is identified generally by the reference numeral 20. The outboard motor 20 is comprised of a power head assembly 22 which is comprised of a powering internal combustion engine 24.

In the illustrated embodiment, the engine 24 is depicted as being a four-cylinder in-line type of engine that operates on a four-cycle combustion principle. It is to be understood, however, that the invention may be utilized with engines having a wide variety of cylinder numbers and cylinder arrangements. Also, certain facets of the invention may be employed with rotary engines. In addition, although the invention is described in conjunction with a four-cycle engine, it should be apparent that certain facets of the invention have utility in conjunction with two-cycle engines. However, certain features of the invention have particular utility in conjunction with four-cycle engines because of their lubrication requirements and systems, as will become apparent.

The engine 24 is comprised of a cylinder block 26 in which four horizontally extending, vertically spaced cylinder bores are formed and contain pistons that are connected by means of connecting rods (none of these components being illustrated), which drive a crankshaft 28. As is typical with outboard motor practice, the engine 24 is positioned within the power head 22 so that the crankshaft 28 rotates about a vertically extending axis. The crankshaft 28 is journaled within a crankcase chamber that is formed by the cylinder block 26 and a crankcase member 30 that is affixed to the cylinder block 26 in a known manner.

The engine 24 further includes a cylinder head 32 that is affixed to the cylinder block 26 and which contains a valve mechanism for operating intake and exhaust valves for admitting an intake charge to the combustion chambers of the engine and for exhausting it. This arrangement includes a single overhead camshaft that is contained within a cam chamber closed by a cam cover 34. The camshaft is driven from the crankshaft 28 by a drive mechanism that includes a timing belt 36.

The remainder of the power head 22 includes a protective cowling 40 that is comprised of a lower tray portion 42 which may be formed from a lightweight, high-strength material such as aluminum or an aluminum alloy or the like. A main cowling portion 44 fits onto the tray 42 and is affixed thereon by means that include a latch assembly 46.

The engine 24 is mounted within the cowling assembly 40 as thus far described upon an exhaust guide 48. The exhaust guide 48 is positioned at the upper end of a drive shaft housing 50. The driveshaft housing 50 is at least partially surrounded by the tray 42 at its upper end.

A drive shaft 52 extends through the exhaust guide 48 and is rotatably coupled in a well-known manner to the engine crankshaft 28. This drive shaft 52 depends through the drive shaft housing 50 into a lower unit 56. At or near the interface between the drive shaft housing 50 and the lower unit 56, the drive shaft 52 is coupled to a water pump 58 which circulates water for cooling of the engine 24 and other purposes, as will be described. The water is drawn through a plurality of inlets (not shown) formed in the lower unit 56 and is directed upwardly through a supply conduit 60. Additional features and structure of the engine cooling system will be described in more detail below.

As has been noted, the drive shaft 52 depends into the lower unit 56 and there drives a conventional forward/neutral/reverse transmission 62. The transmission selectively couples the driveshaft to a propeller 64 that is journaled on a propeller shaft in the lower unit 56 in a known manner for exerting a propulsion force on an associated watercraft.

A steering shaft (not shown) is affixed to the drive shaft housing 50 in a known manner and is journaled for steering movement within a swivel bracket 66.

The swivel bracket 66 is pivotally connected by means of a pivot pin 68 to a clamping bracket 70. The clamping bracket 70 includes a clamping device by which it may be affixed to a transom of an associated watercraft. The pivotal connection provided by the pivot pin 68 permits the outboard motor 20 to be pivoted to any of a plurality of trim adjusted positions and to a tilted-up out-of-the-water position, as is also known in this art.

The construction of the outboard motor 20 as thus far described may be considered to be conventional. Therefore, where any components of the outboard motor 20, including those of the engine 24, have not been described in any more detail, they may be considered to be conventional.

Figure 2:
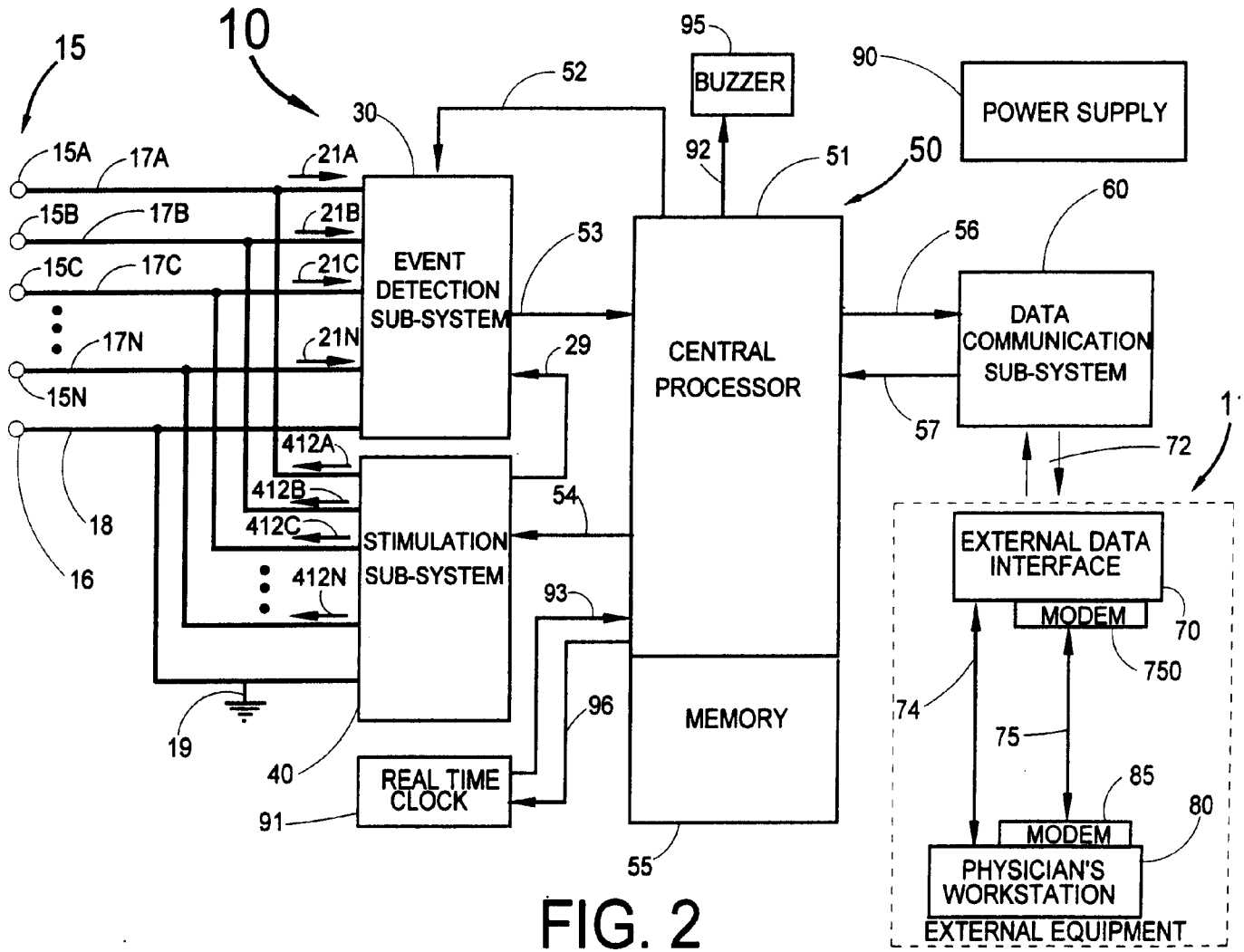
FIG. 2 is an enlarged partial sectional view or a driveshaft housing and exhaust guide of the outboard motor shown in FIG. 1.

With next reference to FIG. 2, the driveshaft 52 is enclosed within a driveshaft chamber 72 defined between a front wall 76 of the driveshaft housing 50 and a generally-vertical front divider wall 80.

A coolant chamber 82 is defined within the driveshaft housing 50. The coolant chamber 82 lies between the front divider wall 80 and a rear wall 84 of the chamber. The rear wall 84 includes an upper divider portion 86 and a lower divider wall portion 88. The front and rear divider walls cooperate with a bottom wall 90 of the driveshaft housing to enclose the coolant chamber 82 therebetween.

As discussed above, coolant from the body of water in which the watercraft is operated is delivered through the coolant supply conduit 60 to various coolant jackets within the engine 24. After being circulated through the engine, the coolant is directed through a drain passage 92 formed in the exhaust guide 48 and into the coolant chamber 82. During engine operation, the coolant accumulates within the coolant chamber 82, forming a coolant bath.

A coolant exit passage 94 is arranged within the coolant chamber 82. An upper end 96 of the coolant exit passage 94 acts as a weir, so that when the coolant bath reaches level L within the coolant chamber, excess coolant spills over into the exit passage 94. The exit passage 94 communicates coolant downwardly into a lower coolant passage 98 defined between the lower rear divider wall 88 and a rear wall 100 of the driveshaft housing 50. A tube section 102 communicates coolant from the upper coolant exit passage 94 to the lower coolant passage 98.

Figure 3:
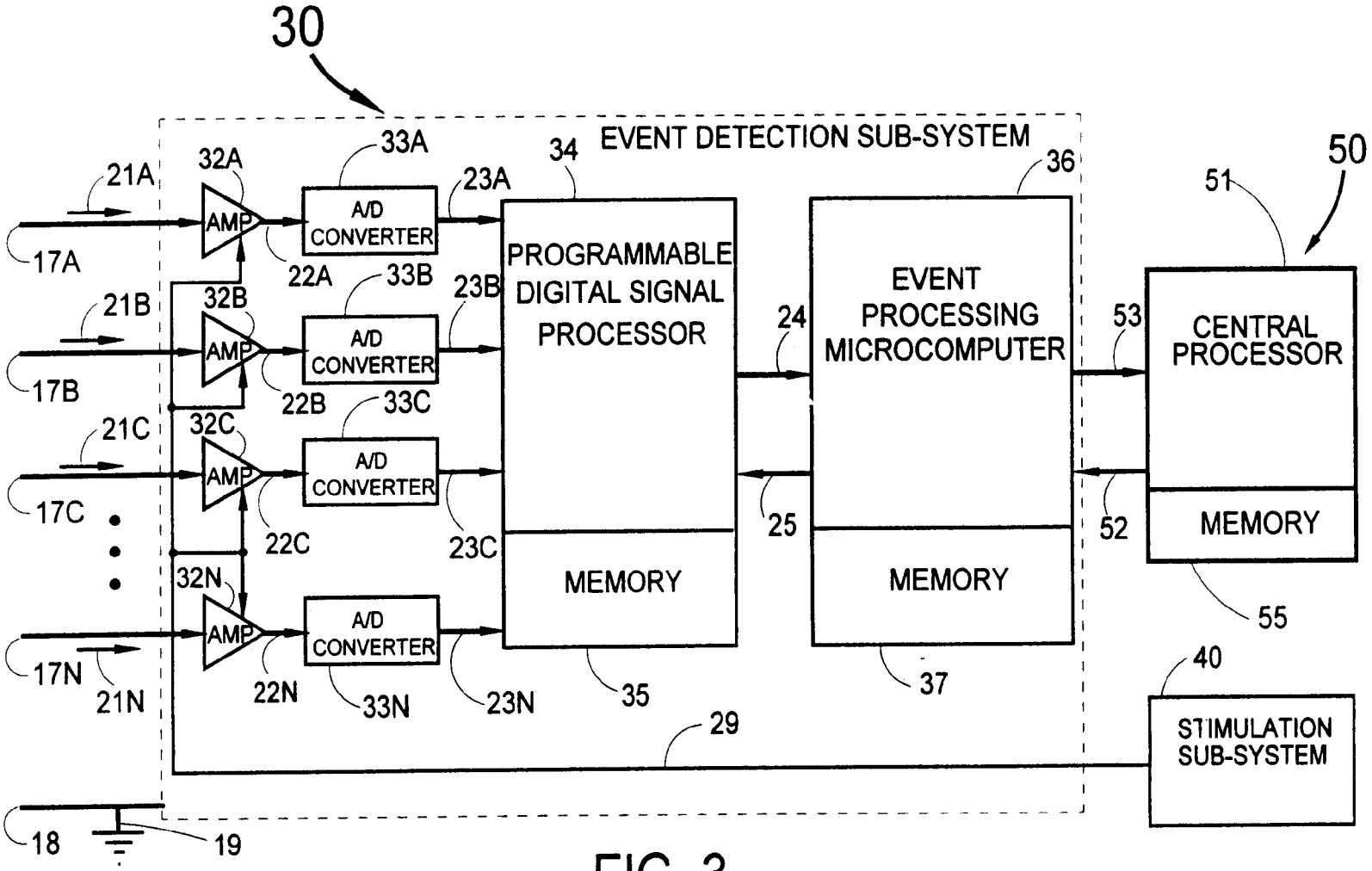
FIG. 3 is a bottom plan view of the driveshaft housing of FIG. 2.
Figure 4:
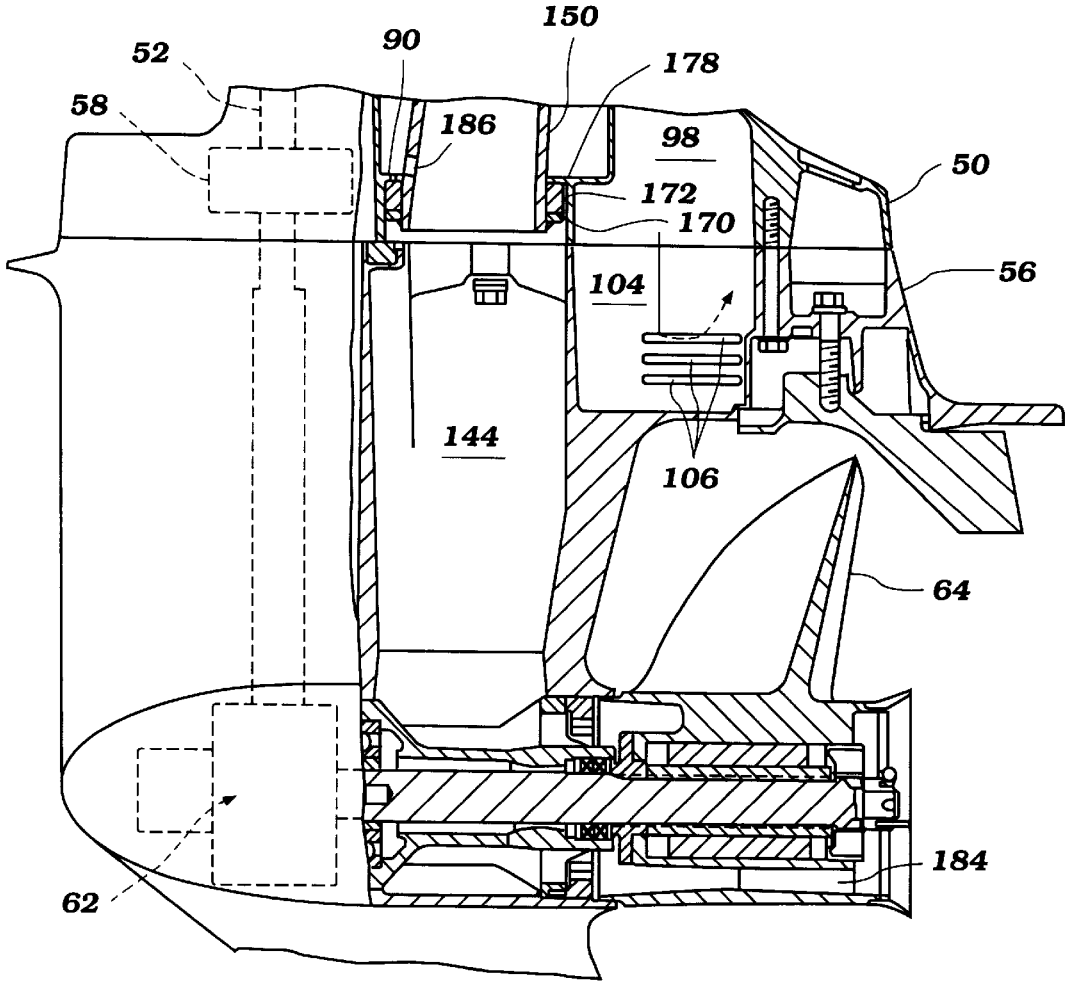
FIG. 4 is an enlarged partial sectional view of a lower portion of the driveshaft housing and a lower unit of the outboard motor of FIG. 1.

With reference also to FIGS. 3 and 4, coolant flows from the lower coolant passage 98 into a coolant passage 104 defined in the lower unit 56. A coolant outlet 106 is formed through the wall of the lower unit and communicates with the lower unit coolant passage 104. Coolant is directed through the outlet 106 and back to the body of water from which the coolant was taken.

The engine 24 is provided with an internal lubricating system through which lubricant is circulated by means of a lubricant pump (not shown). The pump draws lubricant from a lubricant reservoir 110, which is contained in the upper end of the drive shaft housing 50, and circulates the lubricant through the engine 24 in any well-known manner. This lubricant is then returned by gravity to the lubricant tank 110.

With reference again to FIGS. 1 and 2, the lubricant tank 110 depends from the exhaust guide 48 and is connected thereto by fasteners 112. Side and bottom walls 114, 120 define the lubricant reservoir 110, in which lubricant from the engine 24 accumulates and from which the pump draws lubricant. A lubricant drain 122 is formed through a wall of the lubricant tank and communicates with a corresponding drain hole 124 formed through the driveshaft housing 50. A threaded bolt 126 closes the drain.

A central mounting portion 130 of the lubricant tank 110 has an exhaust passage 132 formed therethrough. The central exhaust passage 132 aligns with and communicates with an exhaust passage 134 formed through the exhaust guide 48. The exhaust guide exhaust passage 134 is aligned with an engine exhaust manifold that communicates exhaust products from the combustion chambers to the exhaust passage 134. Inner side walls 136 of the lubricant tank 110 are arranged to allow an exhaust pipe 140 to extend therebetween and to align with the central mount exhaust passage 132.

The exhaust pipe 140 depends from the central mount 130 and directs exhaust products through the driveshaft housing 50 to an exhaust chamber 144 within the lower unit 56. The exhaust pipe 140 is divided into an upstream exhaust pipe section 148 and a downstream exhaust pipe section 150 which are formed separately from each other. An upper end 152 of the upstream exhaust pipe 148 connects to the mount portion 130 by way of a gasket 154 so as to establish a sealing fit with the mount portion 130. The upstream exhaust pipe 148 then depends downwardly from the mount portion 130.

An exhaust pipe support member 160 depends from the bottom wall 120 of the lubricant tank 110 and is preferably attached thereto by fasteners 161. A coolant subchamber 163 is defined between the support member 160 and the bottom wall 120. The coolant subchamber is open to the coolant chamber 82 so that coolant can flow between the subchamber 163 and the coolant chamber 82. The tube section 102 is also preferably defined between the support member 160 and the bottom wall 120.

The upstream exhaust pipe 148 depends from the mount portion 130 to the exhaust pipe support member 160. A flange 162 and gasket 164 adjacent a lower end 165 of the upstream exhaust pipe 148 engage the support member 160 to establish a sealing fit therewith. The upstream exhaust pipe 148 is held in place by bolts. It is to be understood, however, that the upstream exhaust pipe 148 can be fit into place (e.g., press-fit or slip-fit) with the pipe support 160 in lieu of bolts or other fasteners.

The downstream exhaust pipe 150 depends from the exhaust pipe support member 160 and through an opening 166 in the bottom wall 90 of the coolant chamber 82. An upper flange 167 and upper gasket 168 are arranged near the upper end 169 of the downstream exhaust pipe 150. A substantially tubular mount portion 171 of the pipe support 160 is adapted to sealingly engage the upper end 169, including the flange 167 and the gasket 168, in a manner to place the downstream exhaust pipe 150 in communication with the upstream exhaust pipe 148, and to prevent coolant from the coolant chamber 82 from undesirably leaking into the exhaust pipe.

With reference to FIGS. 2–4, a support plate 170 and sealing member 172 are arranged adjacent a lower end 174 of the downstream exhaust pipe 150. The support plate 170 and sealing member 172 together comprise a mount 176 that engages a bottom side 178 of the bottom wall 90 of the coolant chamber 82. Securing bolts 180 fitted through the support plate 170 hold the downstream exhaust pipe 150 in place and ensure a sealed fit both of the upper end 169 of the downstream exhaust pipe with the exhaust pipe support member 160 and of the downstream exhaust pipe with the bottom wall 90 of the coolant chamber 82. Thus, the upper flange 167 and gasket 167 are preferably press-fit into place without the use of bolts or other fasteners. However, it is to be understood that bolts can be used if desired to enhance the sealed fit.

When the exhaust pipes 148, 150 are assembled, exhaust gases flow from the engine 24 through the exhaust passage 134 of the exhaust guide 148 and into the upstream exhaust pipe 148, from which exhaust gases are communicated to the downstream exhaust pipe 150 and into the lower unit exhaust passage 144. From the lower unit exhaust passage 144, exhaust gases are directed through an axial exhaust discharge 184 port through the propeller hub.

The above-described arrangement enables the downstream exhaust pipe 150 to be easily removed independent of the upstream exhaust pipe 148 by removing the securing bolts 180 and drawing the downstream exhaust pipe 150 downwardly through the opening 166 in the bottom wall 90. Similarly, the downstream exhaust pipe 150 can be installed by advancing the upper end 169 of the exhaust pipe 150 through the opening 166 and into engagement with the pipe support member 160, and then securing the pipe 150 in place by installing the securing bolts 180. Such removal and installation are performed with the lower unit 56 removed.

The lower end 174 of the downstream exhaust pipe 150 preferably has a cross-sectional area greater than a cross-sectional area of the upper end 169 of the pipe 150. This arrangement enables exhaust gases within the pipe 150 to expand, helping to silence such gases, and also enables the upper flange 167 of the exhaust pipe 150 to be drawn through the opening 166 during removal or installation. It is to be understood that instead of or in addition to forming the lower end 174 of the downstream exhaust pipe 150 with a greater cross-sectional area than the upper end 169, the upper flange 167 and the opening 166 can be complementarily keyed so that the upper flange 167 can be drawn through the opening 166.

When the downstream exhaust pipe 150 is secured in place, the arrangement of the illustrated embodiment provides for cooling of both the lubricant in the lubricant tank 110 and the exhaust products passing through the exhaust pipe 140. As shown in FIG. 2, the lubricant tank 110 is disposed at least partially below the coolant level L when the engine is operating. Additionally, the outer sidewalls 114 of the lubricant tank 110 are spaced from the front divider wall 80 and upper rear divider wall 86 of the coolant chamber 82, and the inside walls 136 are spaced from the upstream exhaust pipe 148. This arrangement allows coolant to flow completely around the lubricant tank 110 and between the lubricant tank 110 and the upstream exhaust pipe 148. Heat transfer from the exhaust to the lubricant is reduced, as is heat transfer from the lubricant or exhaust to the driveshaft housing 50. Because of the sealing engagement of the upstream and downstream exhaust pipes 148, 150, coolant does not undesirably leak into the exhaust system.

At least one drain hole 186 is formed through the wall of the downstream exhaust pipe 150 immediately adjacent the bottom wall 90 of the driveshaft housing 50 and at or near the lowermost point of the coolant chamber 82. In this manner, during engine operation, a relatively small amount of coolant is delivered into the downstream exhaust pipe 150. Additionally, when the engine is no longer operating, the drain hole 186 enables coolant within the coolant chamber 82 to be substantially completely drained from the chamber 82, even if the outboard motor 20 is tilted upwardly.

Figure 5:
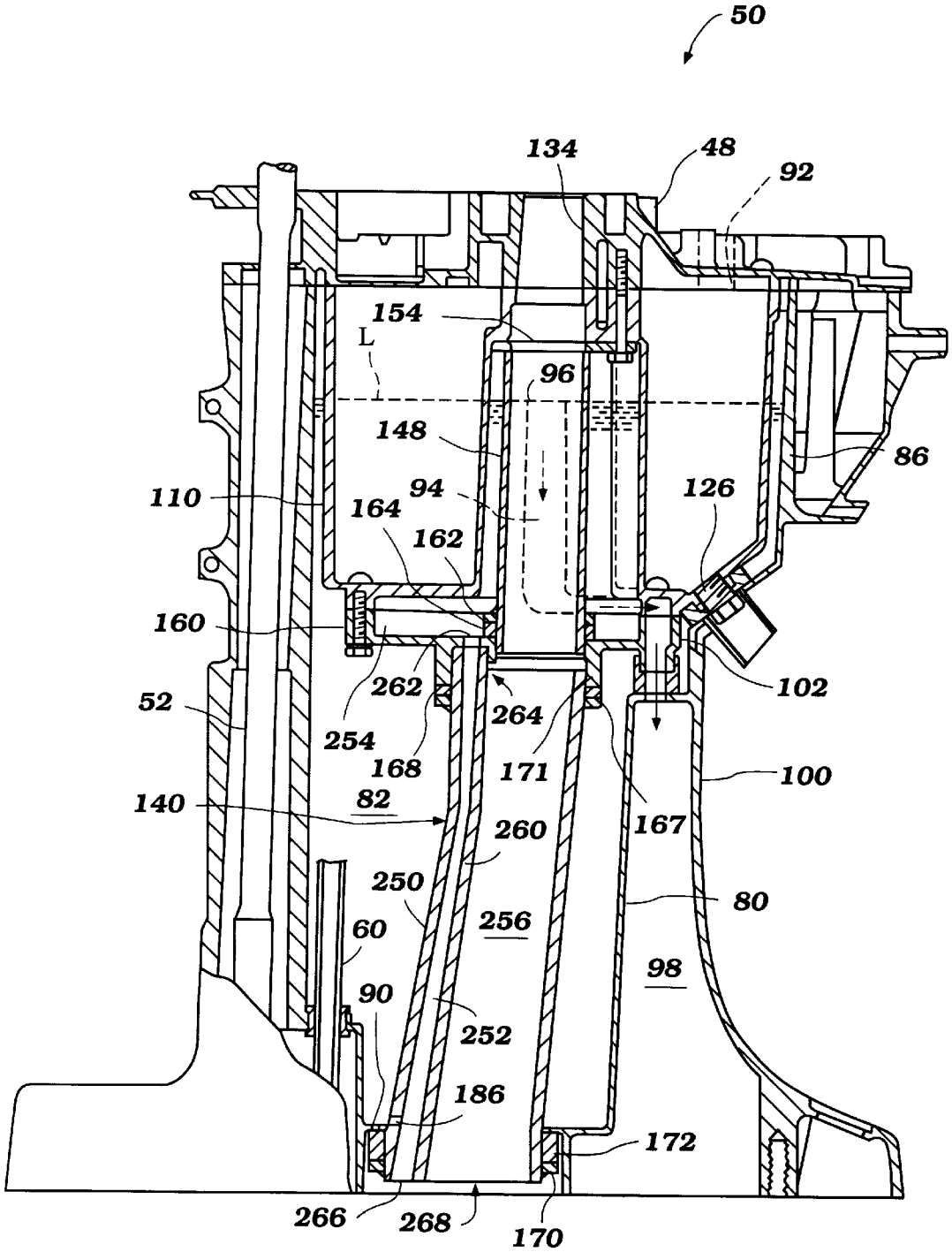
FIG. 5 is a partial sectional view of a driveshaft housing similar to that of FIG. 2, but showing the driveshaft housing constructed in accordance with another embodiment of the invention.
Figure 6:
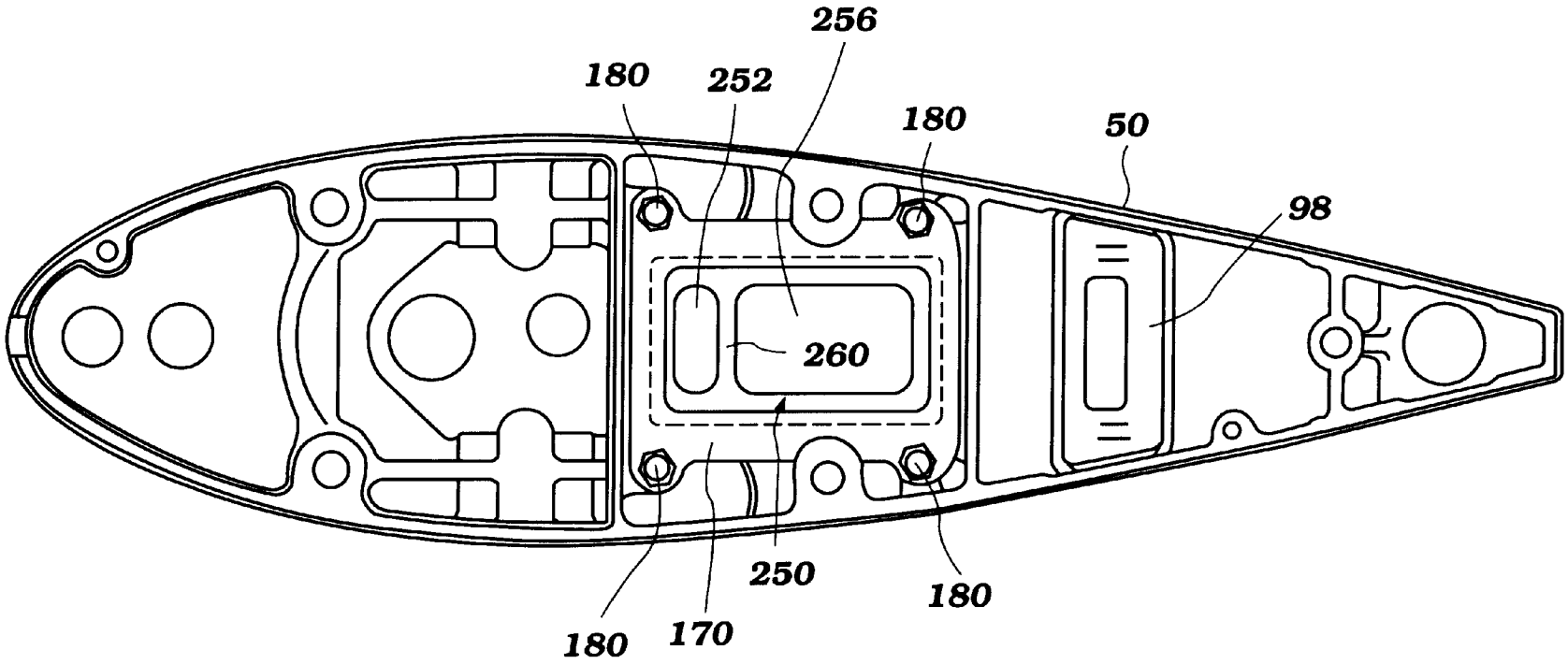
FIG. 6 is a bottom plan view of the driveshaft housing of FIG. 5.
Figure 7:
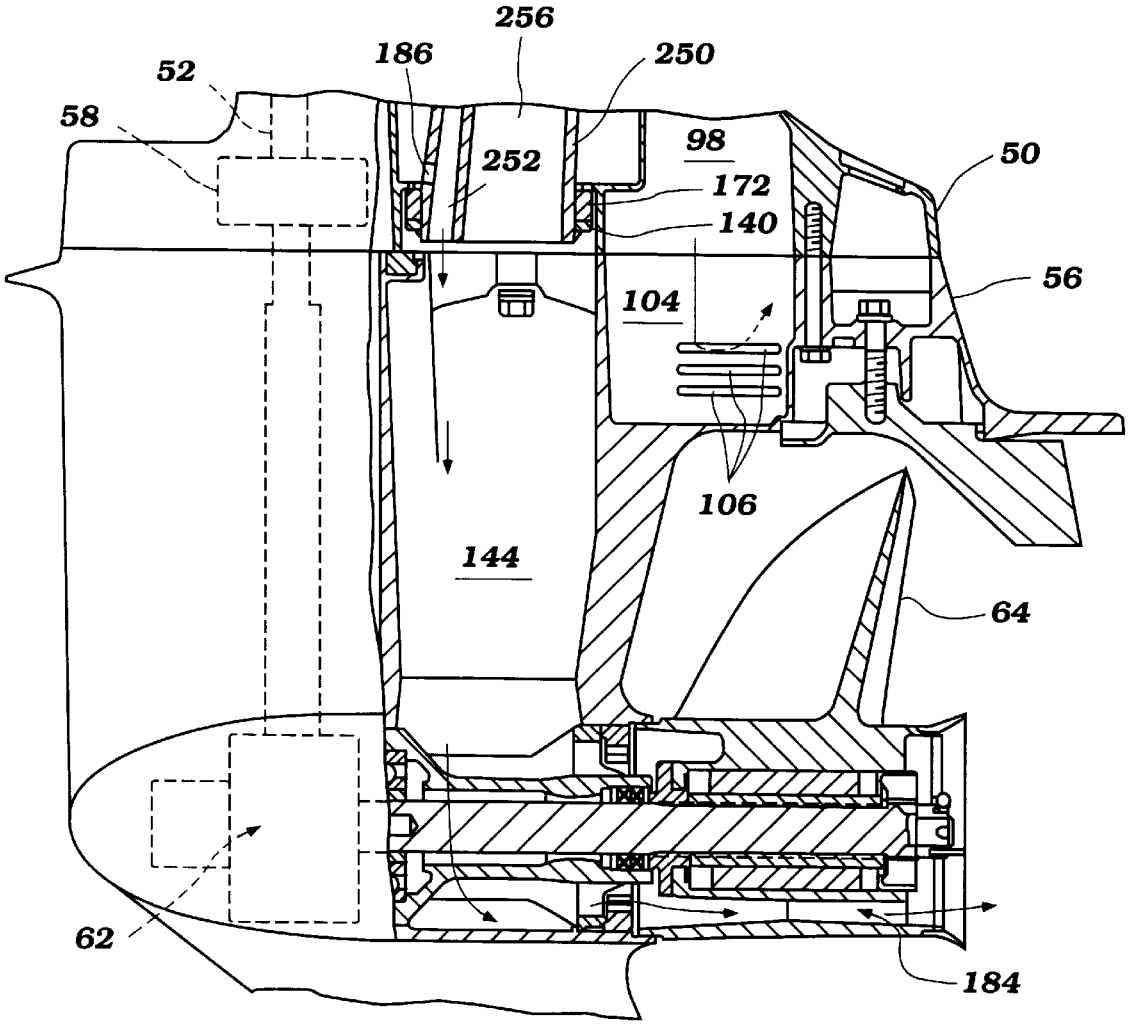
FIG. 7 is a partial sectional view of a lower portion of the driveshaft housing of FIG. 5 attached to a lower unit of the outboard motor.

With next reference to FIGS. 5–7, an additional embodiment of the present invention is substantially similar to the embodiment discussed above, except that a downstream exhaust pipe 250 includes a coolant passage 252 which is adapted to deliver a portion of coolant from the coolant bath into the lower unit exhaust passage 144 in order to cool the exhaust and provide silencing.

The coolant passage portion 252 and an exhaust passage portion 256 of the downstream exhaust pipe 250 run generally parallel to each other and are separated by an internal wall 260. The downstream exhaust pipe 250 is preferably integrally formed, meaning that the exhaust passage portion 256, coolant passage portion 252 and internal wall 260 are formed unitarily as a single component or comprise an assembly of separately-formed components assembled into one piece.

With specific reference to FIG. 5, a coolant subchamber 254 is defined between the exhaust pipe support member 160 and the bottom wall 120 of the oil pan 110. The subchamber 254 communicates with the coolant chamber 82 so that coolant flows therebetween. A coolant inlet 262 at the upper end 264 of the downstream exhaust pipe coolant passage 252 communicates with the coolant subchamber 254 so that coolant from the coolant chamber 82 enters the inlet 262 and is directed downwardly adjacent the exhaust passage 256 and out of an outlet 266 into the lower unit exhaust passage 56. The coolant is mixed with exhaust gases in the lower unit exhaust passage 56. This both cools and helps to silence the gases. The mixture is then eventually directed out of the outboard motor 20 through the main exhaust discharge 184 through the hub of the propeller 64.

When the body of water in which the motor is operating is an ocean or other saltwater body, and saltwater coolant is mixed with hot exhaust gases, corrosive gases can be generated. Since the saltwater is mixed with the exhaust in an area adjacent a lower end 268 of the downstream exhaust pipe 250, it can be expected that corrosion is concentrated adjacent the lower end 268 of the downstream exhaust pipe 250; thus, the lower end 268 will exhibit corrosion to a much greater extent and faster than the upper end 264 of the downstream exhaust pipe or any portion of the upstream exhaust pipe 148. Accordingly, the easy replaceability of the downstream exhaust pipe 250 facilitates easier and less expensive maintenance for the outboard motor 20.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor comprising a power head including an internal combustion engine, a driveshaft housing depending from the power head, a lower unit depending from the driveshaft housing, an upstream exhaust pipe receiving exhaust gases from the engine and depending into the driveshaft housing, and a downstream exhaust pipe formed separately from the upstream exhaust pipe and communicating therewith, the downstream exhaust pipe opening into an exhaust chamber formed in the lower unit and being removable from the driveshaft housing independently from the upstream exhaust pipe.

2. The outboard motor of claim 1, wherein the downstream pipe comprises a mount adjacent a lower end thereof, and the mount engages a bottom wall of the driveshaft housing.

3. The outboard motor of claim 2, wherein the mount engages a bottom surface of the bottom wall, and the downstream pipe extends through an opening through the bottom wall.

4. The outboard motor of claim 1, wherein a lubricant tank depends into the driveshaft housing, and a pipe support member is attached to a bottom of the lubricant tank.

5. The outboard motor of claim 4, wherein the upstream exhaust pipe extends to the pipe support member, and an upper end of the downstream exhaust pipe sealingly engages the pipe support member.

6. The outboard motor of claim 5, wherein the downstream exhaust pipe depends through an opening formed through a bottom wall of the driveshaft housing, and the downstream pipe has a mount positioned on a side of the wall opposite the pipe support member.

7. The outboard motor of claim 6, wherein fasteners releasably secure the mount to the wall and the upper end of the downstream exhaust pipe is fitted into the pipe support member.

8. The outboard motor of claim 1, wherein a coolant chamber is defined within the driveshaft housing, and the downstream exhaust pipe extends through an opening formed in a bottom wall of the coolant chamber.

9. The outboard motor of claim 8, wherein a drain passage is formed communicating the coolant chamber with the downstream exhaust pipe, the drain passage being formed adjacent the bottom wall.

10. The outboard motor of claim 8, wherein the downstream exhaust pipe comprises an exhaust passage portion and a coolant passage portion, and the exhaust and coolant passage portions are separated by a divider wall, the coolant passage communicating with the coolant chamber.

11. The outboard motor of claim 10, wherein the coolant passage portion extends substantially the full length of the downstream exhaust pipe.

12. The outboard motor of claim 10, wherein the coolant passage portion is integrally formed with the exhaust passage portion.

13. An outboard motor comprising a power head including an internal combustion engine, a driveshaft housing depending from the power head, a lower unit depending from the driveshaft housing, an exhaust pipe assembly guiding exhaust products through at least a portion of the driveshaft housing, the exhaust pipe assembly comprising an upstream exhaust pipe section and a downstream exhaust pipe section, the downstream exhaust pipe section extending through an opening in a bottom wall of the driveshaft housing, and means for removably securing the downstream pipe section to the driveshaft housing in a manner so that an upper end of the downstream pipe section communicates with a lower end of the upstream pipe section and the downstream pipe section is removable by drawing the downstream pipe section downwardly through the opening.

14. An outboard motor comprising a power head, a driveshaft housing depending from the power head, a lower unit depending from the driveshaft housing, an internal combustion engine enclosed within the power head and adapted to drive a crankshaft, and an exhaust system adapted to communicate exhaust products from the engine to an exhaust discharge located on the lower unit, the exhaust system comprising an upstream exhaust pipe, a downstream exhaust pipe, and an exhaust pipe support member, the upstream exhaust pipe depending into the driveshaft housing and being supported by the exhaust pipe support member, the downstream exhaust pipe depending from the exhaust pipe support member and through an opening formed through a bottom wall of the driveshaft housing, the downstream exhaust pipe having a mount portion adapted to releasably engage the driveshaft housing, and the downstream pipe and the opening are configured so that the downstream exhaust pipe can be drawn downwardly through the opening to remove the downstream pipe from the driveshaft housing.

15. The outboard motor of claim 14, wherein the mount is adapted to releasably engage a side of the bottom wall opposite the pipe support member.

16. The outboard motor of claim 15, wherein the mount portion sealingly engages the bottom wall of the driveshaft housing.

17. The outboard motor of claim 15, wherein a cross-sectional area of a lower end of the downstream exhaust pipe is greater than a cross-sectional area of an upper end of the downstream pipe.

18. The outboard motor of claim 15, wherein an upper end of the downstream pipe comprises a flange, the flange being adapted to sealingly engage the pipe support member, and the flange and the opening in the bottom wall are adapted so that the flange can be advanced through the opening.

19. The outboard motor of claim 14, wherein a coolant chamber is defined within the driveshaft housing, and the downstream exhaust pipe comprises a coolant passage and an exhaust passage, the coolant passage having an inlet communicating with the coolant chamber and an outlet communicating with the exhaust discharge.

20. The outboard motor of claim 19, wherein the downstream exhaust pipe is integrally formed.

21. The outboard motor of claim 19, wherein a divider wall within the downstream exhaust pipe separates the coolant passage from the exhaust passage.

22. An outboard motor comprising a power head, a driveshaft housing depending from the power head, a lower unit depending from the driveshaft housing, an internal combustion engine enclosed within the power head and adapted to drive a crankshaft, the crankshaft rotatably communicating with a propulsion device provided on the lower unit, a coolant chamber defined within the driveshaft housing, and an exhaust system adapted to communicate exhaust products from the engine to an exhaust discharge disposed at the lower unit, the exhaust system comprising an upstream exhaust pipe, a downstream exhaust pipe, and an exhaust pipe support member, the upstream exhaust pipe depending into the driveshaft housing and being supported by the exhaust pipe support member, the downstream exhaust pipe depending from the exhaust pipe support member and configured to be removable from the driveshaft housing independent of the upstream exhaust pipe, and a drain passage formed through a wall of the downstream pipe, the drain passage communicating with the coolant chamber.

23. The outboard motor of claim 22, wherein the downstream exhaust pipe depends through an opening formed through a bottom wall of the driveshaft housing, the downstream exhaust pipe having a mount portion adapted to releasably engage the bottom wall, and the downstream pipe is adapted so that it can be drawn downwardly through the opening to remove the downstream pipe from the driveshaft housing.

24. The outboard motor of claim 23, wherein the bottom wall of the driveshaft housing comprises at least a portion of a bottom wall of the coolant chamber, and the drain passage is positioned near the bottom wall of the driveshaft housing.

* * * * *